US009573661B1

(12) United States Patent
Plaia et al.

(10) Patent No.: US 9,573,661 B1
(45) Date of Patent: Feb. 21, 2017

(54) SYSTEMS AND METHODS FOR CONTROLLING RECOIL OF ROPE UNDER FAILURE CONDITIONS

(71) Applicant: Samson Rope Technologies, Ferndale, WA (US)

(72) Inventors: James R. Plaia, Ferndale, WA (US); Chia-Te Chou, Bellingham, WA (US); Kurt Newboles, Lynden, WA (US); Greg Zoltan Mozsgai, Blaine, WA (US)

(73) Assignee: Samson Rope Technologies, Ferndale, WA (US)

( * ) Notice: Subject to any disclaimer, the term of this patent is extended or adjusted under 35 U.S.C. 154(b) by 0 days.

(21) Appl. No.: 14/801,715

(22) Filed: Jul. 16, 2015

(51) Int. Cl.
*B63B 21/00* (2006.01)
*B63B 21/20* (2006.01)
*B63B 21/04* (2006.01)

(52) U.S. Cl.
CPC ..... *B63B 21/20* (2013.01); *B63B 21/04* (2013.01); *B63B 2021/005* (2013.01); *B63B 2021/203* (2013.01)

(58) Field of Classification Search
CPC ..... B63B 21/20; B63B 21/04
See application file for complete search history.

(56) References Cited

U.S. PATENT DOCUMENTS 429,174 A 6/1890 Ogily
568,531 A 9/1896 Harthan
1,257,398 A 2/1918 Roach
1,479,865 A 1/1924 Metcalf
1,490,387 A 4/1924 Hansen
1,695,480 A 12/1928 Buoy
1,710,740 A 4/1929 Ljungkull
(Continued)

FOREIGN PATENT DOCUMENTS

CA 2019499 2/2000
CN 200910203184 6/2009
(Continued)

OTHER PUBLICATIONS

ACMA, Pultrusion Industry Council, http://www.acmanet.org/pic/products/description.htm, "products & process: process description", 2001, 2 pages.
(Continued)

*Primary Examiner* — Stephen Avila
(74) *Attorney, Agent, or Firm* — Michael R. Schacht; Schacht Law Office, Inc.

(57) ABSTRACT

A rope system adapted to be connected between first and second structures comprises a rope recoil system comprising first and second rope recoil assemblies. The first rope recoil assembly defines a first length and a first predetermined rope recoil maximum limit at which the first rope recoil assembly fails when under tension. The second rope recoil assembly defines a second length, where the second length is longer than the first length. The rope recoil assembly is arranged between the first and second structures such that the rope recoil system is in a first configuration. When at least one of the first and second structures moves away from another of the first and second structures, the first rope recoil assembly fails and the rope recoil system reconfigures into a second configuration.

28 Claims, 7 Drawing Sheets

(56) References Cited

U.S. PATENT DOCUMENTS

| | | | |
|---|---|---|---|
| 1,769,945 | A | 7/1930 | Erkert |
| 1,833,587 | A | 11/1931 | Page |
| 1,850,767 | A | 3/1932 | Page |
| 1,908,686 | A | 5/1933 | Burke |
| 1,931,808 | A | 10/1933 | Hans |
| 2,070,362 | A | 2/1937 | Willy |
| 2,074,956 | A | 3/1937 | Carstarphen |
| 2,245,824 | A | 6/1941 | George |
| 2,299,568 | A | 10/1942 | Dickey |
| 2,338,831 | A | 1/1944 | Whitcomb et al. |
| 2,359,424 | A | 10/1944 | Joy |
| 2,480,005 | A | 8/1949 | Ewell |
| 2,840,983 | A | 7/1958 | Keilbach |
| 2,960,365 | A | 11/1960 | Meisen |
| 3,035,476 | A | 5/1962 | Fogden |
| 3,073,209 | A | 1/1963 | Benk et al. |
| 3,276,810 | A | 10/1966 | Antell |
| 3,358,434 | A | 12/1967 | Mccann |
| 3,367,095 | A | 2/1968 | Field |
| 3,371,476 | A | 3/1968 | Costello et al. |
| 3,383,849 | A | 5/1968 | Stirling |
| 3,411,400 | A | 11/1968 | Morieras et al. |
| 3,415,052 | A | 12/1968 | Stanton |
| 3,425,737 | A | 2/1969 | Sutton |
| RE26,704 | E | 11/1969 | Norton |
| 3,481,134 | A | 12/1969 | Whewell |
| 3,507,949 | A | 4/1970 | Campbell |
| 3,537,742 | A | 11/1970 | Black |
| 3,561,318 | A | 2/1971 | Andriot, Jr. |
| 3,653,295 | A | 4/1972 | Pintard |
| 3,662,533 | A | 5/1972 | Snellman et al. |
| 3,718,945 | A | 3/1973 | Brindejonc de Treglode |
| 3,729,920 | A | 5/1973 | Sayers et al. |
| 3,762,865 | A | 10/1973 | Weil |
| 3,771,305 | A | 11/1973 | Barnett |
| 3,839,207 | A | 10/1974 | Weil |
| 3,854,767 | A | 12/1974 | Burnett |
| 3,904,458 | A | 9/1975 | Wray |
| 3,906,136 | A | 9/1975 | Weil |
| 3,915,618 | A | 10/1975 | Feucht et al. |
| 3,943,644 | A | 3/1976 | Walz |
| 3,957,923 | A | 5/1976 | Burke |
| 3,968,725 | A | 7/1976 | Holzhauer |
| 3,977,172 | A | 8/1976 | Kerawalla |
| 3,979,545 | A | 9/1976 | Braus et al. |
| 4,022,010 | A | 5/1977 | Gladenbeck et al. |
| 4,031,121 | A | 6/1977 | Brown |
| 4,036,101 | A | 7/1977 | Burnett |
| 4,050,230 | A | 9/1977 | Senoo et al. |
| 4,056,928 | A | 11/1977 | de Vries |
| 4,099,750 | A | 7/1978 | McGrew |
| 4,116,481 | A | 9/1978 | Raue |
| 4,155,394 | A | 5/1979 | Shepherd et al. |
| 4,159,618 | A | 7/1979 | Sokaris |
| 4,170,921 | A | 10/1979 | Repass |
| 4,173,113 | A | 11/1979 | Snellman et al. |
| 4,184,784 | A | 1/1980 | Killian |
| 4,195,113 | A | 3/1980 | Brook |
| 4,202,164 | A | 5/1980 | Simpson et al. |
| 4,210,089 | A | 7/1980 | Lindahl |
| 4,226,035 | A | 10/1980 | Saito |
| 4,228,641 | A | 10/1980 | O'Neil |
| 4,232,619 | A | 11/1980 | Lindahl |
| 4,232,903 | A | 11/1980 | Welling et al. |
| 4,250,702 | A | 2/1981 | Gundlach |
| 4,257,221 | A | 3/1981 | Feinberg |
| 4,258,608 | A | 3/1981 | Brown |
| 4,286,429 | A | 9/1981 | Lin |
| 4,312,260 | A | 1/1982 | Morieras |
| 4,321,854 | A | 3/1982 | Foote et al. |
| 4,329,794 | A | 5/1982 | Rogers |
| 4,350,380 | A | 9/1982 | Williams |
| 4,375,779 | A | 3/1983 | Fischer |
| 4,403,884 | A | 9/1983 | Barnes |
| 4,412,474 | A | 11/1983 | Hara |
| 4,421,352 | A | 12/1983 | Raue et al. |
| 4,464,812 | A | 8/1984 | Crook et al. |
| 4,500,593 | A | 2/1985 | Weber |
| 4,509,233 | A | 4/1985 | Shaw |
| 4,534,163 | A | 8/1985 | Schuerch |
| 4,534,262 | A | 8/1985 | Swenson |
| 4,563,869 | A | 1/1986 | Stanton |
| 4,606,183 | A | 8/1986 | Riggs |
| 4,619,108 | A | 10/1986 | Hotta |
| 4,635,989 | A | 1/1987 | Tremblay et al. |
| 4,640,179 | A | 2/1987 | Cameron |
| 4,642,854 | A | 2/1987 | Kelly et al. |
| 4,674,801 | A | 6/1987 | DiPaola et al. |
| 4,677,818 | A | 7/1987 | Honda et al. |
| 4,757,719 | A | 7/1988 | Franke |
| 4,762,583 | A | 8/1988 | Kaempen |
| 4,779,411 | A | 10/1988 | Kendall |
| 4,784,918 | A | 11/1988 | Klett et al. |
| 4,850,629 | A | 7/1989 | St. Germain |
| 4,856,837 | A | 8/1989 | Hammersla |
| 4,868,041 | A | 9/1989 | Yamagishi et al. |
| 4,887,422 | A | 12/1989 | Klees et al. |
| 4,947,917 | A | 8/1990 | Noma et al. |
| 4,958,485 | A | 9/1990 | Montgomery et al. |
| 4,974,488 | A | 12/1990 | Spralja |
| 4,978,360 | A | 12/1990 | Devanathan |
| 5,060,466 | A | 10/1991 | Matsuda et al. |
| 5,091,243 | A | 2/1992 | Tolbert et al. |
| 5,141,542 | A | 8/1992 | Fangeat et al. |
| 5,178,923 | A | 1/1993 | Andrieu et al. |
| 5,211,500 | A | 5/1993 | Takaki et al. |
| D338,171 | S | 8/1993 | Bichi |
| 5,240,769 | A | 8/1993 | Ueda et al. |
| 5,288,552 | A | 2/1994 | Hollenbaugh, Jr. et al. |
| 5,296,292 | A | 3/1994 | Butters |
| 5,327,714 | A | 7/1994 | Stevens et al. |
| 5,333,442 | A | 8/1994 | Berger |
| 5,378,522 | A | 1/1995 | Lagomarsino |
| 5,426,788 | A | 6/1995 | Meltzer |
| 5,429,869 | A | 7/1995 | McGregor et al. |
| 5,441,790 | A | 8/1995 | Ratigan |
| 5,483,911 | A | 1/1996 | Kubli |
| 5,497,608 | A | 3/1996 | Matsumoto et al. |
| 5,501,879 | A | 3/1996 | Murayama |
| 5,506,043 | A | 4/1996 | Lilani |
| 5,525,003 | A | 6/1996 | Williams et al. |
| 5,636,506 | A | 6/1997 | Yngvesson |
| 5,643,516 | A | 7/1997 | Raza et al. |
| 5,651,572 | A | 7/1997 | St. Germain |
| 5,669,214 | A | 9/1997 | Kopanakis |
| 5,699,657 | A | 12/1997 | Paulson |
| 5,711,243 | A | 1/1998 | Dunham |
| 5,718,532 | A | 2/1998 | Mower |
| 5,727,833 | A | 3/1998 | Coe |
| 5,802,839 | A | 9/1998 | Van Hook |
| 5,822,791 | A | 10/1998 | Baris |
| 5,826,421 | A | 10/1998 | Wilcox et al. |
| 5,852,926 | A | 12/1998 | Breedlove |
| 5,873,758 | A | 2/1999 | Mullins |
| 5,904,438 | A | 5/1999 | Vaseghi et al. |
| 5,931,076 | A | 8/1999 | Ryan |
| 5,943,963 | A | 8/1999 | Beals |
| 5,978,638 | A | 11/1999 | Tanaka et al. |
| 6,015,618 | A | 1/2000 | Orima |
| 6,033,213 | A | 3/2000 | Halvorsen, Jr. |
| 6,045,571 | A | 4/2000 | Hill et al. |
| 6,085,628 | A | 7/2000 | Street et al. |
| 6,122,847 | A | 9/2000 | Treu et al. |
| 6,146,759 | A | 11/2000 | Land |
| 6,164,053 | A | 12/2000 | Olsen |
| 6,265,039 | B1 | 7/2001 | Drinkwater et al. |
| 6,295,799 | B1 | 10/2001 | Baranda |
| 6,341,550 | B1 | 1/2002 | White |
| 6,365,070 | B1 | 4/2002 | Stowell et al. |
| 6,405,519 | B1 | 6/2002 | Shaikh et al. |
| 6,410,140 | B1 | 6/2002 | Land et al. |
| 6,422,118 | B1 | 7/2002 | Edwards |
| 6,484,423 | B1 | 11/2002 | Murray |
| 6,524,690 | B1 | 2/2003 | Dyksterhouse |

(56) References Cited

U.S. PATENT DOCUMENTS

| | | | |
|---|---|---|---|
| 6,575,072 | B2 | 6/2003 | Pellerin |
| 6,592,987 | B1 | 7/2003 | Sakamoto et al. |
| 6,601,378 | B1 | 8/2003 | Fritsch et al. |
| 6,704,535 | B2 | 3/2004 | Kobayashi et al. |
| 6,876,798 | B2 | 4/2005 | Triplett et al. |
| 6,881,793 | B2 | 4/2005 | Sheldon et al. |
| 6,916,533 | B2 | 7/2005 | Simmelink et al. |
| 6,945,153 | B2 | 9/2005 | Knudsen et al. |
| 7,051,664 | B2 | 5/2006 | Robichaud et al. |
| 7,093,416 | B2 | 8/2006 | Johnson et al. |
| 7,127,878 | B1 | 10/2006 | Wilke et al. |
| 7,134,267 | B1 | 11/2006 | Gilmore et al. |
| 7,137,617 | B2 | 11/2006 | Sjostedt |
| 7,165,485 | B2 | 1/2007 | Smeets et al. |
| 7,168,231 | B1 | 1/2007 | Chou et al. |
| 7,172,878 | B1 | 2/2007 | Nowak et al. |
| 7,182,900 | B2 | 2/2007 | Schwamborn et al. |
| 7,296,394 | B2 | 11/2007 | Clough et al. |
| 7,331,269 | B2 | 2/2008 | He et al. |
| 7,367,176 | B1 | 5/2008 | Gilmore et al. |
| 7,389,973 | B1 | 6/2008 | Chou et al. |
| 7,415,783 | B2 | 8/2008 | Huffman et al. |
| 7,437,869 | B1 | 10/2008 | Chou et al. |
| 7,472,502 | B2 | 1/2009 | Gregory et al. |
| 7,475,926 | B2 | 1/2009 | Summars |
| D592,537 | S | 5/2009 | Darnell |
| 7,568,419 | B2 | 8/2009 | Bosman |
| 7,637,549 | B2 | 12/2009 | Hess |
| 7,681,934 | B2 | 3/2010 | Harada et al. |
| 7,735,308 | B1 | 6/2010 | Gilmore et al. |
| 7,739,863 | B1 | 6/2010 | Chou et al. |
| 7,743,596 | B1 | 6/2010 | Chou et al. |
| 7,784,258 | B2 | 8/2010 | Hess |
| 7,823,496 | B2 | 11/2010 | Bosman et al. |
| 7,849,666 | B2 | 12/2010 | Kirth et al. |
| 7,908,955 | B1 | 3/2011 | Chou et al. |
| 7,918,079 | B2 | 4/2011 | Bloch |
| 8,109,071 | B2 | 2/2012 | Gilmore |
| 8,109,072 | B2 | 2/2012 | Chou et al. |
| 8,171,713 | B2 | 5/2012 | Gilmore et al. |
| 8,171,714 | B2 | 5/2012 | Wienke et al. |
| 8,240,119 | B2 | 8/2012 | Fujimoto et al. |
| 8,250,845 | B2 | 8/2012 | Kimura et al. |
| 8,302,374 | B2 | 11/2012 | Marissen et al. |
| 8,341,930 | B1 | 1/2013 | Chou et al. |
| 8,387,505 | B2 | 3/2013 | Chou et al. |
| 8,418,434 | B1 | 4/2013 | Carruth et al. |
| 8,511,053 | B2 | 8/2013 | Chou et al. |
| 8,689,534 | B1 | 4/2014 | Chou |
| 8,707,666 | B2 | 4/2014 | Crozier et al. |
| 8,707,668 | B2 | 4/2014 | Gilmore et al. |
| 9,003,757 | B2 | 4/2015 | Mozsgai et al. |
| 9,074,318 | B2 | 7/2015 | Chou et al. |
| 9,404,203 | B2 | 8/2016 | Gilmore et al. |
| 2003/0200740 | A1 | 10/2003 | Tao et al. |
| 2003/0226347 | A1 | 12/2003 | Smith et al. |
| 2004/0025486 | A1 | 2/2004 | Takiue |
| 2004/0069132 | A1 | 4/2004 | Knudsen et al. |
| 2005/0036750 | A1 | 2/2005 | Triplett et al. |
| 2005/0172605 | A1 | 8/2005 | Vancompernolle et al. |
| 2005/0279074 | A1 | 12/2005 | Johnson et al. |
| 2006/0048494 | A1 | 3/2006 | Wetzels et al. |
| 2006/0048497 | A1 | 3/2006 | Bloch |
| 2006/0115656 | A1 | 6/2006 | Martin |
| 2006/0179619 | A1 | 8/2006 | Pearce et al. |
| 2006/0213175 | A1 | 9/2006 | Smith et al. |
| 2007/0079695 | A1 | 4/2007 | Bucher et al. |
| 2007/0137163 | A1 | 6/2007 | Hess |
| 2007/0144134 | A1 | 6/2007 | Kajihara |
| 2007/0169457 | A1 | 7/2007 | Kijesky |
| 2007/0266693 | A1 | 11/2007 | Kato et al. |
| 2008/0299855 | A1 | 12/2008 | Morihashi |
| 2009/0047475 | A1 | 2/2009 | Jeon |
| 2009/0127394 | A1* | 5/2009 | Adarve Lozano ..... B64D 39/00 244/135 A |
| 2009/0282801 | A1 | 11/2009 | Gilmore |
| 2009/0301052 | A1 | 12/2009 | Chou et al. |
| 2011/0067275 | A1 | 3/2011 | Doan |
| 2011/0083415 | A1 | 4/2011 | Marissen et al. |
| 2011/0097530 | A1 | 4/2011 | Gohil et al. |
| 2011/0192132 | A1 | 8/2011 | Kimura et al. |
| 2011/0197564 | A1 | 8/2011 | Zachariades et al. |
| 2011/0269360 | A1 | 11/2011 | Mueller |
| 2012/0121843 | A1 | 5/2012 | Lebel et al. |
| 2012/0198808 | A1 | 8/2012 | Bosman et al. |
| 2012/0244333 | A1 | 9/2012 | Aksay et al. |
| 2012/0260620 | A1 | 10/2012 | Kim et al. |
| 2012/0266583 | A1 | 10/2012 | Crozier et al. |
| 2012/0297746 | A1 | 11/2012 | Chou et al. |
| 2013/0174719 | A1 | 7/2013 | Chou et al. |
| 2014/0000233 | A1 | 1/2014 | Chou et al. |
| 2014/0057103 | A1 | 2/2014 | Mozsgai et al. |
| 2014/0070557 | A1 | 3/2014 | Mozsgai et al. |
| 2014/0230635 | A1 | 8/2014 | Gilmore et al. |
| 2014/0250856 | A1 | 9/2014 | Chou |
| 2014/0260927 | A1 | 9/2014 | Gilmore et al. |
| 2014/0272409 | A1 | 9/2014 | Chou |
| 2014/0311118 | A1 | 10/2014 | Mozsgai et al. |
| 2015/0217973 | A1 | 8/2015 | Mozsgai et al. |

FOREIGN PATENT DOCUMENTS

| | | | |
|---|---|---|---|
| DE | 7315621 | U | 10/1973 |
| EP | 1397304 | A1 | 3/2004 |
| EP | 2130969 | A2 | 12/2009 |
| FR | 2197392 | | 3/1974 |
| GB | 312464 | | 5/1929 |
| JP | 469565 | | 4/1971 |
| JP | 57161116 | | 10/1982 |
| JP | 1260080 | | 10/1989 |
| JP | 2242987 | | 9/1990 |
| JP | 3033285 | | 2/1991 |
| JP | 200212884 | | 8/2000 |
| JP | 2004126505 | | 4/2004 |
| JP | 2009293181 | | 12/2009 |
| JP | 3158927 | | 4/2010 |
| KR | 1019900010144 | | 7/1990 |
| KR | 1020090044381 | | 5/2009 |
| RU | 2100674 | | 12/1997 |
| RU | 2295144 | | 3/2007 |
| RU | 2425187 | | 7/2011 |
| SU | 618061 | | 7/1978 |
| SU | 1647183 | | 5/1991 |
| WO | 03102295 | | 12/2003 |
| WO | 2004021771 | A2 | 3/2004 |
| WO | 2005075559 | A1 | 8/2005 |
| WO | 2008144046 | A1 | 11/2008 |
| WO | 2008144047 | A1 | 11/2008 |
| WO | 2008144048 | A1 | 11/2008 |
| WO | 2014043136 | A1 | 3/2014 |
| WO | 2014138157 | A1 | 9/2014 |
| WO | 2014151957 | A1 | 9/2014 |
| WO | 2014159457 | A1 | 10/2014 |
| WO | 2014159460 | A1 | 10/2014 |
| ZA | 2009008815 | | 8/2010 |

OTHER PUBLICATIONS

Bridon, "Fibre Rope Catalogue: M Steel Winchline", 2011, p. 17.
Bridon, "Fibre Rope Catalogue: TQ12", 2011, p. 18.
ENTEC, http://www.entec.com/pultrusion.shtml, "Pultrusion Equipment", Nov. 2006, 4 pages.
H. A. McKenna et al., "Handbook of fibre rope technology", 2004, pp. 88, 89, 100, Woodhead Publishing Limited, England, CRC Press LLC, USA.
Herzog Braiding Machines, "Rope Braiding Machines Seng 140 Series", predates 2004, 2 pages.
Herzog Braiding Machines, "Rope Braiding Machines Seng 160 Series", predates 2004, 2 pages.
International Searching Authority, ISR, PCT/US2012023742, Aug. 21, 2014, 8 pages.
International Searching Authority, ISR, PCT/US2012039460, Sep. 13, 2012, 7 pages.

(56) References Cited

OTHER PUBLICATIONS

International Searching Authority, ISR, PCT/US2014020529, Jun. 10, 2014, 7 pages.
International Searching Authority, ISR, PCT/US2014023749, Jun. 26, 2014, 7 pages.
International Searching Authority, ISR, PCT/US2014026726, Jun. 19, 2014, 7 pages.
Kaneya Seiko Co., Ltd., "Super Triple Cross Rope", 2007, 3 pages.
Pasternak, Shelton, & Gilmore, "Synthetic 'Mud Ropes' for Offshore Mooring Applications—Field History and Testing Data", Sep. 2011, 8 pages.
Samson Rope Technologies, Inc., "Dynalene Installation Instructions for Covering 12-Strand Rope", 2005, 12 pages.
Samson Rope Technologies, Inc., "Innovative Chafe Protection Solutions for High Performance Ropes", 2006, 4 pages.
Samson Rope Technologies, Inc., "M-8 Offshore Rope", Mar. 2008, 1 page.
Samson Rope Technologies, Inc., "Offshore Product and Technical Guide", Jul. 2011, 8 pages.
Samson Rope Technologies, Inc., "Samson Deep Six Performs Beyond Expectation", Sep. 10, 2008, 2 pages.
Samson Rope Technologies, Inc., "Samson Offshore Expansion Celebrated", Feb. 18, 2009, 2 pages.
Samson Rope Technologies, Inc., www.samsonrope.com/Pages/Product.aspx?ProductID=825, "Tenex-Tec", 2012, 1 page.
TENCOM Ltd., http://www.tencom.com/02/pultrusion.htm, "Pultrusion Process", 2006, 2 pages.
Timberland Equipment Limited, "Gatortail Rope Synthetic Pulling Rope", 2010, 5 pages.
US District Court, *Samson Rope Technologies, Inc.* v. *Yale Cordage, Inc.* Case 2:11-cv-00328, Document 1, Complaint (2), DI 001-2011-02-24, 5 pages.
US District Court, *Samson Rope Technologies, Inc.* v. *Yale Cordage, Inc.* Case 2:11-cv-00328-JLR, Document 12, Answer, DI 012-2011-05-10, 6 pages.
US District Court, *Samson Rope Technologies, Inc.* v. *Yale Cordage, Inc.* Case 2:11-cv-00328-JLR, Document 5, Notice to PTO, DI 005-2011-02-25, 1 page.

* cited by examiner

SYSTEMS AND METHODS FOR CONTROLLING RECOIL OF ROPE UNDER FAILURE CONDITIONS

TECHNICAL FIELD

The present invention relates to rope systems and methods and, in particular, to systems and methods for reducing recoil of a failed rope assembly.

BACKGROUND

A rope assembly is typically a combination of individual elongate rope elements. A metal rope comprises metal wires, a natural rope comprises natural fibers, and a synthetic rope comprises synthetic fibers. The elements of a rope can be made of the same material, or a rope can be made of different rope elements. The number of rope elements, functional characteristics of the rope elements, and method by which the rope elements are combined will determine the operating characteristics of the rope.

When a rope assembly fails, at least a portion of the failed rope assembly may move in space, resulting in the potential for danger to persons and/or damage to structures near the point of failure. Movement of a rope assembly upon failure is often referred to as "recoil". The precise nature and extent of the danger posed by the recoil of a failed rope assembly depends on factors such as the nature of the rope assembly and the environment in which the rope assembly is used.

The need exists for systems and methods that minimize the recoil of a rope assembly and thus the danger posed by failure of the rope assembly. The need also exists for systems and methods that allow a user of a rope system to detect whether a rope forming a part of the overall rope system has been loaded past a predetermined design limit.

SUMMARY

The present invention may be embodied as a rope system adapted to be connected between first and second structures comprising a recoil control system comprising first and second recoil control assemblies. The first recoil control assembly defines a first length and a first predetermined recoil control maximum limit at which the first recoil control assembly fails when under tension. The second recoil control assembly defines a second length, where the second length is longer than the first length. The recoil control assembly is arranged between the first and second structures such that the recoil control system is in a first configuration. When at least one of the first and second structures moves away from another of the first and second structures, the first recoil control assembly fails and the recoil control system reconfigures into a second configuration.

The present invention may also be embodied as a method of connecting first and second structures comprising the following steps. A first recoil control assembly defining a first length and a first predetermined recoil control maximum limit at which the first recoil control assembly fails when under tension is provided. A second recoil control assembly defining a second length is provided, where the second length is longer than the first length. The first and second recoil control assemblies are combined to form a recoil control system in a first configuration. The recoil control assembly is arranged between the first and second structures in the first configuration such that, when at least one of the first and second structures moves away from another of the first and second structures, the first recoil control assembly fails and the recoil control system reconfigures into a second configuration.

The present invention may also be embodied as a recoil control system adapted to be connected between a rope assembly and a structure comprising first and second recoil control assemblies. The first recoil control assembly defines a first length and a first predetermined recoil control maximum limit at which the first recoil control assembly fails when under tension. The second recoil control assembly defines a second length, where the second length is longer than the first length. The recoil control assembly is arranged between the rope and the structure such that the recoil control system is in a first configuration. When tension is applied from the rope assembly to the structure through the recoil control system, the first recoil control assembly fails and the recoil control system reconfigures into a second configuration.

DETAILED DESCRIPTION

The principles of the present invention can take a number of forms, and several examples of recoil control systems that may be used as or as part of a system or method of reducing recoil of rope under failure conditions will be described below.

I. First Example Recoil Control System

Referring initially to FIGS. 1-9, depicted therein is a first example recoil control system 20 constructed in accordance with, and embodying, the principles of the present invention. The first example recoil control system 20 is adapted to be connected between a first structure 22 and a second structure 24. In the example depicted in FIG. 1, the first structure 22 is a bollard, cleat or the like supported by a barge, ship, or the like, and the second structure 24 is a bollard, cleat or the like supported by a dock. The first and second structures 22 and 24 are not by themselves part of the present invention, and the first and second structures 22 and 24 will be described herein only to that extent necessary for a complete understanding of the present invention.

Figure 1:
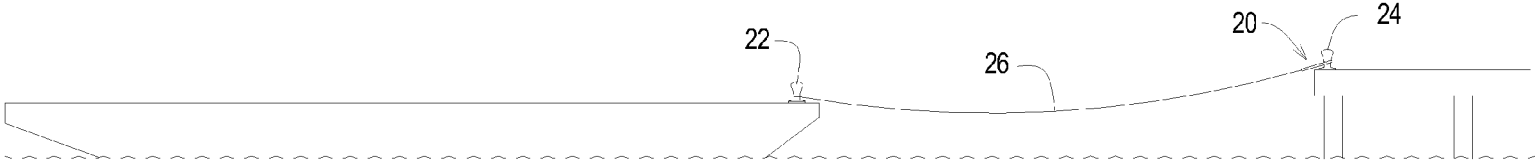
FIG. 1 is a side elevation environmental view depicting the use of a recoil control system of the present invention.
Figure 2:
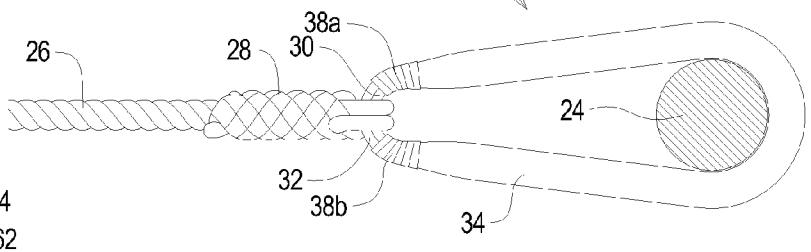
FIG. 2 is a partial, section view illustrating the use of a first example recoil control system of the present invention to connect a rope assembly to a structure.

FIGS. 1 and 2 illustrate that the recoil control system 20 is directly connected to the second structure 24. For example, the first example recoil control system 20 takes the form of a loop that is placed over the bollard forming the second structure 24. The first example recoil control system 20 is connected to the first structure 22 through a rope assembly 26. In the example recoil control system 20, the example rope assembly 26 is spliced at a splice region 28 around a portion of the loop formed by the first example recoil control system 20 such that, under certain conditions, tension loads applied on the rope assembly 26 from the recoil control system 20 at one end and from the first structure 22 at the other end are effectively transferred to the second structure 24 through the first example recoil control system 20 as will be described in detail below. Rope joining methods other than splicing may be used to join the rope assembly 26 to the recoil control system 20 in addition to or instead of the splice region 28 as shown.

The combination of the rope recoil control system 20 and the rope assembly 26 will be referred to as the overall rope system.

Referring now to FIGS. 2-6, it can be seen that the first example recoil control system 20 comprises a first recoil control assembly 30 and a second recoil control assembly 32 and, optionally, a cover 34, a connector 36, and tape 38.

The first recoil control assembly 30 is a closed loop defining a first end portion 40, a second end portion 42, a first side portion 44, and a second side portion 46. The example first recoil control assembly 30 is an endless rope segment comprising synthetic fibers. The individual fibers are typically combined into yarns which are in turn combined into strands. The strands are combined by twisting, braiding, or the like to form the first recoil control assembly 30. The characteristics of the first recoil control assembly 30 are selected such that the first recoil control assembly 30 will break before the rope assembly 26.

The second recoil control assembly 32 is also a closed loop but is folded to define a proximal end portion 50, a distal end portion 52, a first lateral portion 54, and a second lateral portion 56. In the context of this application, the terms "proximal" and "distal" are used with respect to the rope structure 26, but these terms are arbitrarily used and do not indicate any limiting feature of the invention as embodied in the first example recoil control system 20. The example second recoil control assembly 32 is an endless rope segment comprising synthetic fibers. The individual fibers are typically combined into yarns which are in turn combined into strands. The strands are combined by twisting, braiding, or the like to form the second recoil control assembly 32. The characteristics of the second recoil control assembly 30 are selected such that the second recoil control assembly 30 meets the operational requirements described below.

Figure 3:
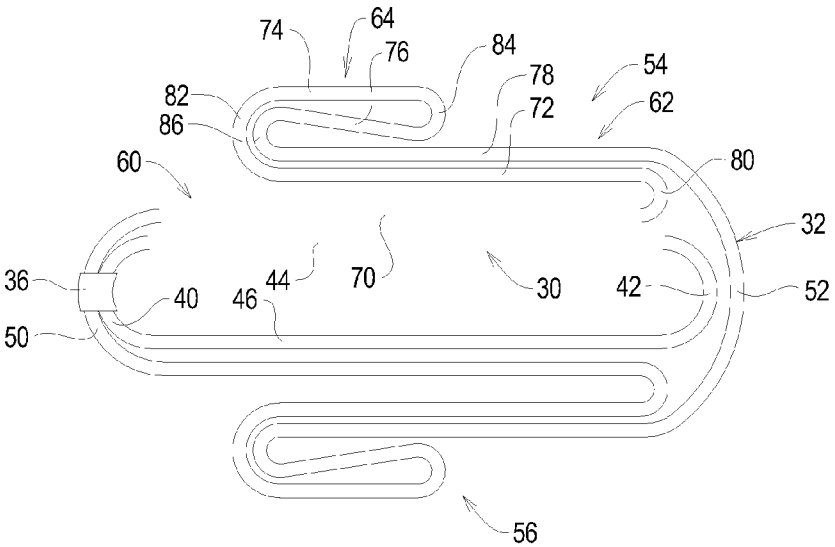
FIG. 3 is a somewhat schematic plan view of a portion of the first example recoil control system in a folded configuration.
Figure 4:
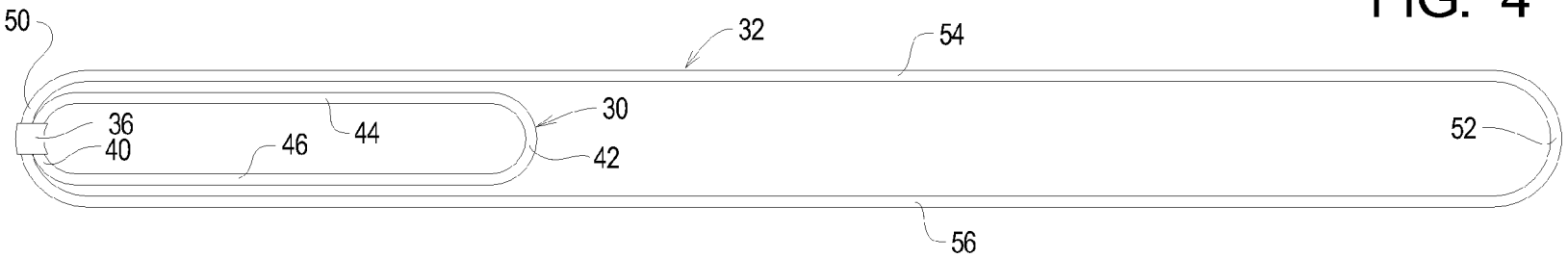
FIG. 4 is a somewhat schematic plan view of a portion of the first example recoil control system in an unfolded configuration.
Figure 5:
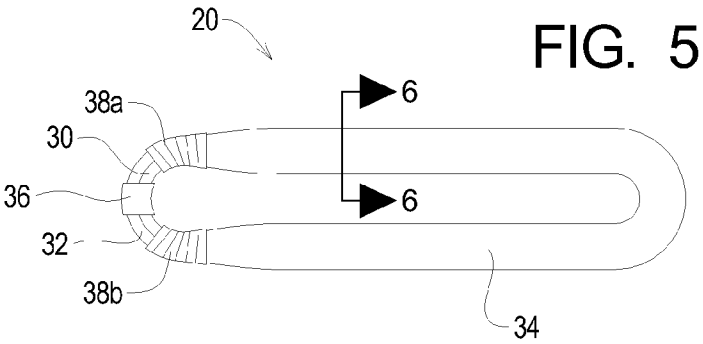
FIG. 5 is a plan view of the first example recoil control system in the folded configuration.
Figure 7:
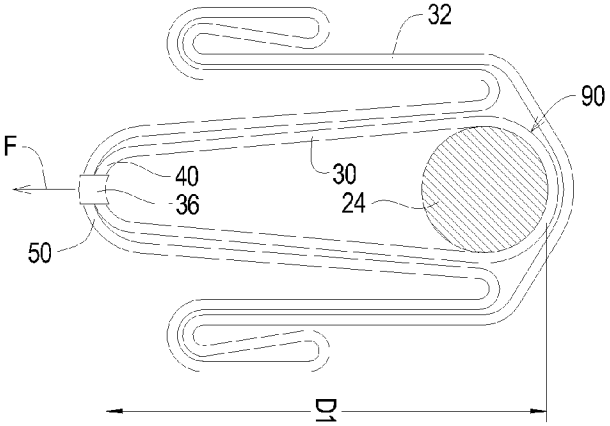
FIG. 7 is a is a somewhat schematic plan view depicting a portion of the first example recoil control system in the folded configuration engaging a first structure and with a force F applied to the first example recoil control system.

The example first and second lateral portions 54 and 56 are or may be the same, and only the first lateral portion 54 will be described in detail herein. In a folded configuration as shown in FIGS. 3, 5, and 7, the first lateral portion 54 defines an initial portion 60, a return portion 62, and an end portion 64. More specifically, the example first lateral portion 54 defines a first segment 70, a second segment 72, a third segment 74, a fourth segment 76, and a fifth segment 78. The example first lateral portion 54 further comprises a first bend 80, a second bend 82, a third bend 84, and a fourth bend 86. The first segment 70 extends between the proximal end portion 50 and the first bend 80. The second segment 72 extends between the first bend 80 and the second bend 82. The third segment 74 extends between the second bend 82 and the third bend 84. The fourth segment 76 extends between the third bend 84 and the fourth bend 86. The fifth segment 78 extends between the fourth bend 86 and the distal end portion 52.

Figure 6:
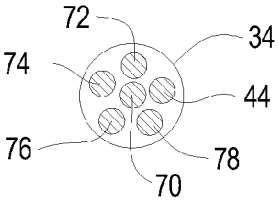
FIG. 6 is a section view taken along lines 6-6 in FIG. 5.

To form the first example recoil control system 20, the connector 36 is arranged to secure the first end portion 40 of the first recoil control assembly 30 to the proximal end portion 50 of the second recoil control assembly 32. The cover 34 is also arranged to secure the second recoil control assembly 32 in its folded configuration with the first and second lateral portions 54 and 56 adjacent to the first and second side portions 44 and 46, respectively. The tape 38 is used to secure the cover 34 in place over the first and second recoil control assemblies 30 and 32 as shown in FIGS. 5 and 6 such that the first example recoil control system 20 is in a first (e.g., retracted or non-extended) configuration. Other methods of securing the cover in place over the recoil control assemblies 30 and 32, such as lashing material such as twine or temporary or permanent adhesive may be used in addition to or instead of tape.

The purpose of the first and second lateral portions 54 and 56 is to make an effective length of the second recoil control assembly 32 in the folded configuration to be approximately the same as the length of the first recoil control assembly 30. As shown in FIG. 7, when the first example recoil control system 20 is in the retracted configuration, the effective length of both of the first and second recoil control assemblies 30 and 32 is approximately the same and defines a first recoil control effective length equal to a distance D1. However, when first example recoil control system 20 is in a second (e.g., extended) configuration as shown in FIG. 9, the effective length of the second recoil control assembly 32 defines a second recoil control effective length equal to a distance D2.

Figure 8:
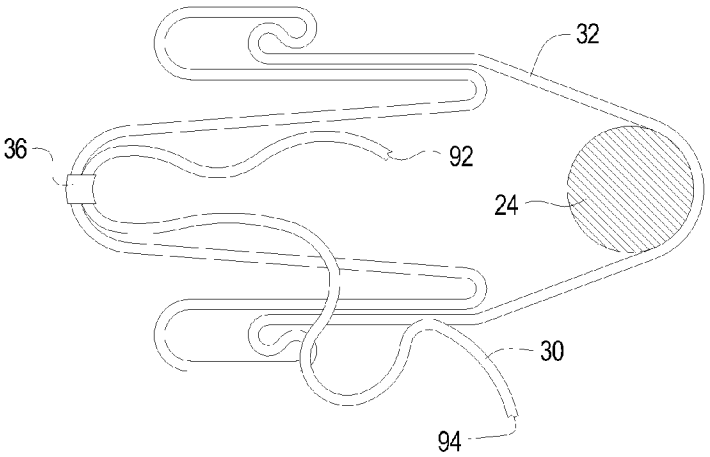
FIG. 8 is a is a somewhat schematic plan view depicting a portion of the first example recoil control system at a first point in time after the force F caused failure of the first example recoil control system.
Figure 9:
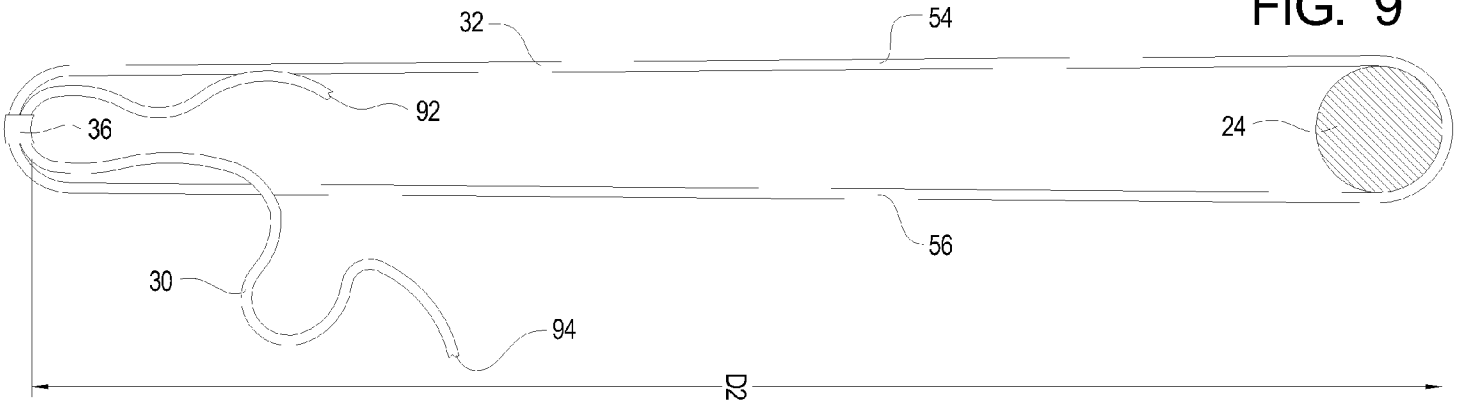
FIG. 9 is a is a somewhat schematic plan view depicting a portion of the first example recoil control system in the unfolded configuration engaging a first structure and at a second point in time after the force F caused failure of the first example recoil control system.

FIGS. 7, 8, and 9 illustrate the process by which the first example recoil control assembly 20 changes from the first configuration to the second configuration. As described above, the first end portion 40 and proximal end portion 50 are secured together by the connector 36, and the rope assembly 26 is connected to the recoil control assembly 20 at the connector 36. The connector 36 may be formed by any appropriate structure such as lashing, straps, binding material, adhesive, or mechanical clip. The cover 34 is, at this point, still held in place over at least the lateral portions 54 and 56 by the tape 38. The first example recoil control assembly 20 is then placed over the second structure 24, and the rope assembly 26 is or already has been connected to the first structure 22.

When either one of the first and second structures 22 and 24 moves away from the other of the first and second structures 22 and 24 (e.g., ship floats away from a dock), tension loads are applied to the rope assembly 26 through the recoil control system 20. These tension loads result in a force F applied to the first end portion 40 and proximal end portion 50 away from the second structure 24. When the force F exceeds a first predetermined maximum recoil control limit at which the first recoil control assembly 30 fails, the first recoil control assembly 30 breaks at a failure region 90 such that the first recoil control assembly 30 defines first and second failure portions 92 and 94.

As generally described above, the rope assembly 26 is constructed such that the rope fails at a predetermined maximum rope limit at which the rope assembly 26 fails under tension, where the first predetermined maximum rope limit is greater than the predetermined maximum recoil control limit. The second recoil control assembly 32 defines a second predetermined maximum recoil control limit at which the second recoil control assembly 32 fails when under tension. The second predetermined maximum recoil control limit may be the same as, greater than, or less than the first predetermined maximum recoil control limit but will in any event typically be less than the predetermined maximum rope limit.

When the first recoil control assembly 30 fails as shown in FIG. 8, the cover 34 typically breaks, unfolds, or otherwise deforms to allow the second recoil control assembly 32 to change from its folded configuration (FIG. 7) to its unfolded configuration (FIG. 9). The first example recoil control assembly 20 thus changes from the first configuration (FIG. 7) to the second configuration (FIG. 9) upon failure of the first recoil control assembly 30. The second recoil control assembly 32 will limit movement of the spliced portion 28 of the rope assembly 26 and thus recoil of the rope assembly 26.

The first example recoil control system 20 further reduces the likelihood that the rope assembly 26 will break when the tension loads on the rope assembly 26 exceed the first predetermined maximum recoil control limit. However, until the first and second structures 22 and 24 move farther away from each other, the second recoil control assembly 32 will prevent the splice region 28 of the rope 26 from moving. Upon failure of the first example recoil control assembly 30, the rope assembly 26 is allowed to retract or recoil in a controlled manner, thereby relieving stress in the overall rope system and thereby preventing, at least temporarily, failure of the rope assembly 26. At this point, steps may be taken to bring the first and second structures 22 and 24 closer together to alleviate tension loads on the rope structure 26 before the tension loads on the second recoil control assembly 32 exceed the second predetermined maximum recoil control limit and thus to prevent failure of the first example recoil control system 20 (e.g., breakage of the second recoil control assembly 32).

The first example recoil control system 20 thus maintains the integrity of the overall rope system formed by the example recoil control system 20 and the rope assembly 26, at least temporarily.

In addition, a user of the recoil control system 20 will know that, if the recoil control system 20 moves from the first configuration to the second configuration, the rope assembly 26 has been subjected to loads sufficient to cause the first recoil control assembly 30 to break. This knowledge may inform the user of the overall rope system that, in addition to failure of the recoil control system 20, the rope assembly 26 may also need inspection, testing, and/or replacement.

II. Second Example Recoil Control System

Referring next to FIGS. 10-13, depicted therein is a second example recoil control system 120 constructed in accordance with, and embodying, the principles of the present invention. The second example recoil control system 120 is adapted to be connected between a first structure (not shown) and a second structure 124. In the example depicted in FIG. 1, the first structure is a cleat or the like supported by a ship, and the second structure 124 is a bollard or the like supported by a dock. The first and second structures are not by themselves part of the present invention, and the first and second structures will be described herein only to that extent necessary for a complete understanding of the present invention.

Figure 10:
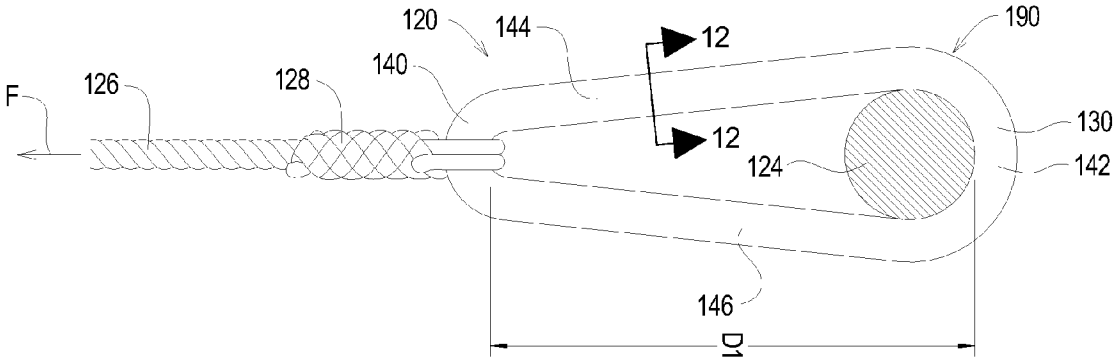
FIG. 10 is a partial, section view illustrating a second example recoil control system of the present invention.

FIG. 10 illustrates that the recoil control system 120 is directly connected to the second structure 124. For example, the second example recoil control system 120 takes the form of a loop that is placed over the bollard forming the second structure 124. The second example recoil control system 120 is connected to the first structure through a rope assembly (not shown). Under certain conditions, tension loads applied on the rope assembly from the recoil control system 120 at one end and from the first structure at the other end are effectively transferred to the second structure 124 through the second example recoil control system 120 as will be described in detail below.

The second example recoil control system 120 comprises a first recoil control assembly 130 and a second recoil control assembly 132.

The first recoil control assembly 130 is a closed, hollow loop defining a first end portion 140, a second end portion 142, a first side portion 144, and a second side portion 146. The example first recoil control assembly 130 is an endless rope segment comprising synthetic fibers. The individual fibers are typically combined into yarns which are in turn combined into strands. The strands are combined by twisting, braiding, or the like to form the first recoil control assembly 130. The characteristics of the first recoil control assembly 130 are selected such that the first recoil control assembly 130 will break before the rope assembly 126 as will be described in further detail below.

The second recoil control assembly 132 is a closed loop but is folded to define a proximal end portion 150, a distal end portion 152, a first lateral portion 154, and a second lateral portion 156. In the context of this application, the terms "proximal" and "distal" are used with respect to the rope structure 126, but these terms are arbitrarily used and do not indicate any limiting feature of the invention as embodied in the second example recoil control system 120. The example second recoil control assembly 132 is an endless rope segment comprising synthetic fibers. The individual fibers are typically combined into yarns which are in turn combined into strands. The strands are combined by twisting, braiding, or the like to form the second recoil control assembly 132. The characteristics of the second recoil control assembly 132 are selected such that the second recoil control assembly 132 meets the operational requirements described below.

Figure 11:
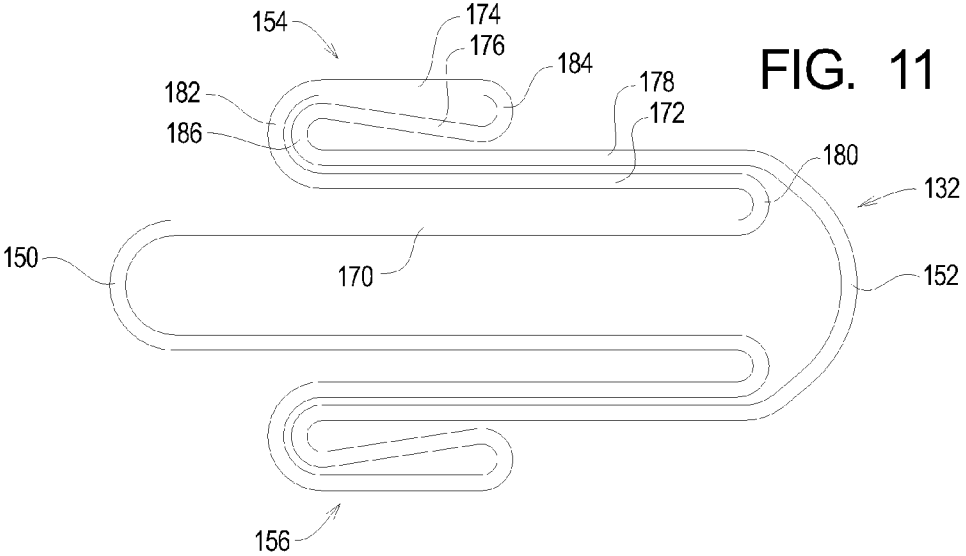
FIG. 11 is a somewhat schematic plan view of a portion of the second example recoil control system in a folded configuration.
Figure 12:
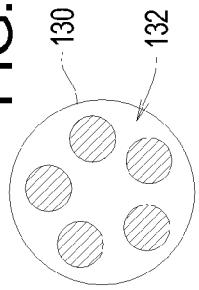
FIG. 12 is a section view taken along lines 12-12 in FIG. 10.

The example first and second lateral portions 154 and 156 are or may be the same, and only the first lateral portion 154 will be described in detail herein. In a folded configuration as shown in FIG. 11, the first lateral portion 154 defines an initial portion 160, a return portion 162, and an end portion 164. More specifically, the example first lateral portion 154 defines a first segment 170, a second segment 172, a third segment 174, a fourth segment 176, and a fifth segment 178. The example first lateral portion 154 further comprises a first bend 180, a second bend 182, a third bend 184, and a fourth bend 186. The first segment 170 extends between the proximal end portion 150 and the first bend 180. The second segment 172 extends between the first bend 180 and the second bend 182. The third segment 174 extends between the second bend 182 and the third bend 184. The fourth segment 176 extends between the third bend 184 and the fourth bend 186. The fifth segment 178 extends between the fourth bend 186 and the distal end portion 152.

To form the second example recoil control system 120, the first recoil control assembly 130 forms a cover that is arranged to secure the second recoil control assembly 132 in its folded configuration with the first and second lateral portions 154 and 156 within the first and second side portions 144 and 146, respectively.

The purpose of the first and second lateral portions 154 and 156 is to make an effective length of the second recoil control assembly 132 in the folded configuration to be approximately the same as the length of the first recoil control assembly 130. As shown in FIGS. 10 and 11, when the second example recoil control system 120 is in the first configuration, the effective length of both of the first and second recoil control assemblies 130 and 132 is approximately the same and defines a first recoil control effective length equal to a distance D1. However, when second example recoil control system 120 is in a second configuration as shown in FIG. 13, the effective length of the second recoil control assembly 132 defines a second recoil control effective length equal to a distance D2.

Figure 13:
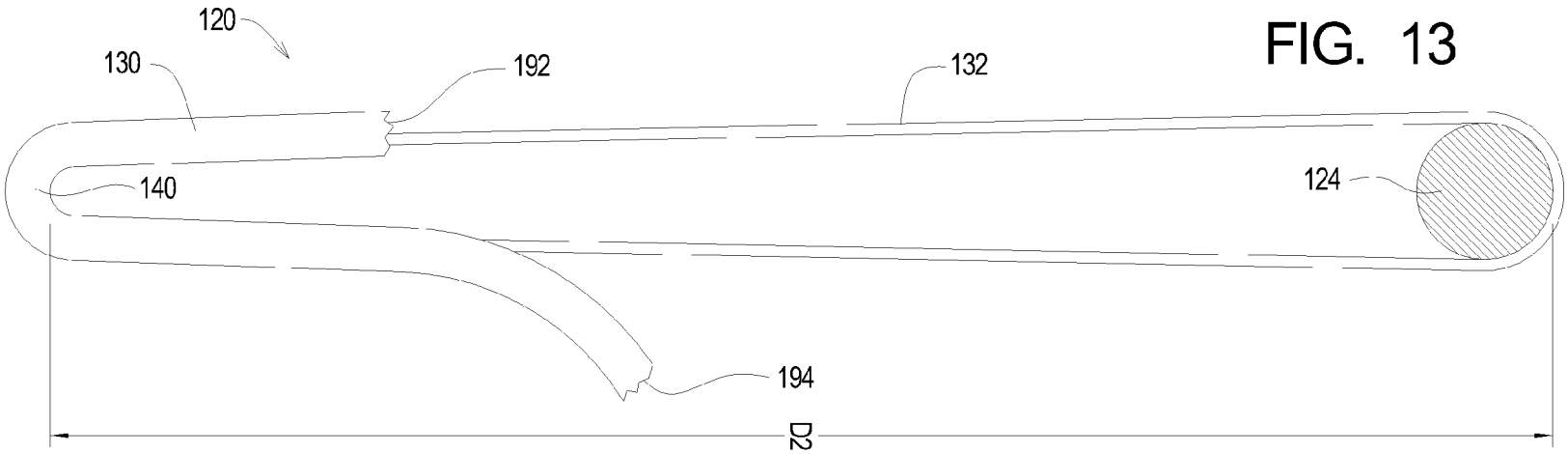
FIG. 13 is a is a partial section plan view depicting the second example recoil control system in an unfolded configuration engaging a first structure and at a second point in time after a force has caused failure of the second example recoil control system.

FIGS. 10 and 13 illustrate the process by which the first example recoil control assembly 120 changes from the first configuration to the second configuration. As described above, the first end portion 140 and proximal end portion 150 are secured to the rope assembly. The first example recoil control assembly 120 is then placed over the second structure 124, and the rope assembly is or already has been connected to the first structure.

When either one of the first and second structures moves away from the other of the first and second structures, tension loads are applied to the rope assembly through the recoil control system 120. These tension loads result in a force F applied to the first end portion 140 and proximal end portion 150 away from the second structure 124. When the force F exceeds a first predetermined maximum recoil control limit, the first recoil control assembly 130 breaks at a failure region 190 such that the first recoil control assembly defines first and second failure portions 192 and 194.

As generally described above, the rope assembly 126 is constructed such that the rope fails at a predetermined maximum rope limit, where the first predetermined maximum rope limit is greater than the predetermined maximum recoil control limit. The second recoil control assembly 132 defines a second predetermined maximum recoil control limit that may be the same as, greater than, or less than the first predetermined maximum recoil control limit but will in any event typically be less than the predetermined maximum rope limit.

When the first recoil control assembly 130 fails as shown in FIG. 13, the cover formed by the first recoil control assembly 130 breaks or otherwise deforms to allow the second recoil control assembly 132 to change from its folded configuration (FIGS. 10 and 11) to its unfolded configuration (FIG. 13). The first example recoil control assembly 120 thus changes from the first configuration (FIG. 10) to the second configuration (FIG. 13) upon failure of the first recoil control assembly 130. The second recoil control assembly 132 will limit movement of the end of the rope assembly connected to the second example recoil control system 120 and thus recoil of the rope assembly.

The second example recoil control system 120 further reduces the likelihood that the rope assembly will break when the tension loads on the rope assembly exceed the first predetermined maximum recoil control limit. However, until the first and second structures 122 and 124 move farther away from each other, the second recoil control assembly 132 will prevent the splice region 128 of the rope 126 from moving. After failure of the first recoil control assembly 130, steps may be taken to bring the first and second structures 122 and 124 closer together to alleviate tension loads on the rope structure before the tension loads on the second recoil control assembly 132 exceed the second predetermined maximum recoil control limit and thus to prevent failure of the second example recoil control system 120 (e.g., breakage of the second recoil control assembly 132).

The second example recoil control system 120 thus maintains the integrity of the overall rope system formed by the example recoil control system 120 and the rope assembly 126, at least temporarily.

In addition, a user of the recoil control system 120 will know that, if the recoil control system 120 moves from the first configuration to the second configuration, the rope assembly 126 has been subjected to loads sufficient to cause the first recoil control assembly 130 to break. This knowledge may inform the user of the overall rope system that, in addition to failure of the recoil control system 120, the rope assembly 126 may also need inspection, testing, and/or replacement.

III. Third Example Recoil Control System

Figure 14:
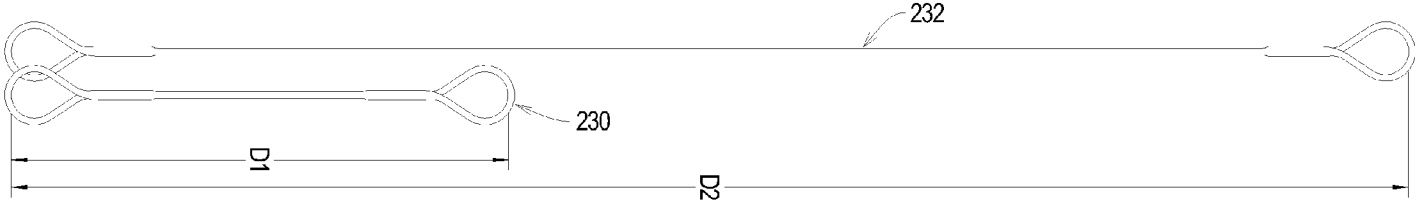
FIG. 14 is a somewhat schematic plan view of a portion of a third example recoil control system in an unfolded configuration.
Figure 15:
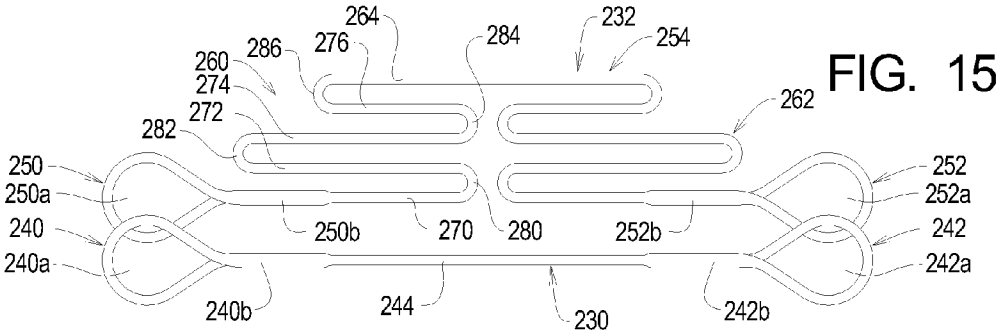
FIG. 15 is a somewhat schematic plan view of a portion of the third example recoil control system in a folded configuration.
Figure 16:
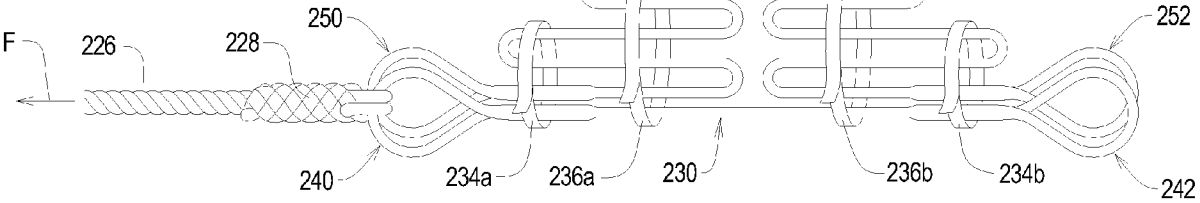
FIG. 16 is a somewhat schematic plan view of the third example recoil control system in the folded configuration.

FIGS. 14-16 illustrate a third example recoil control system 220 constructed in accordance with, and embodying, the principles of the present invention. The third example recoil control system 220 is adapted to be connected between a first structure and a second structure. The first structure may be a cleat or the like supported by a ship, and the second structure may be a bollard or the like supported by a dock. The first and second structures are not by themselves part of the present invention and will be described herein only to that extent necessary for a complete understanding of the present invention.

The example recoil control system 220 is directly connected to the second structure. For example, the third example recoil control system 220 may define a first loop that is placed over the bollard forming the second structure. The third example recoil control system 220 is connected to the first structure through a rope assembly. In the example recoil control system 220, the rope assembly is spliced around a portion of a second loop formed by the third example recoil control system 220 such that, under certain conditions, tension loads applied on the rope assembly from the recoil control system 220 at one end and from the first structure at the other end are effectively transferred to the second structure through the third example recoil control system 220 as will be described in detail below.

The third example recoil control system 220 comprises a first recoil control assembly 230 and a second recoil control assembly 232 and, optionally, first and second end straps 234*a* and 234*b* and first and second middle straps 236*a* and 236*b*.

The first recoil control assembly 230 is a rope segment defining a first end portion 240, a second end portion 242, and a middle portion 244. The first end portion defines a first loop 240*a* and a second splice 240*b*. The second end portion defines a second loop 242*a* and a second splice 242*b*. The example first recoil control assembly 230 comprises synthetic fibers. The individual fibers are typically combined into yarns which are in turn combined into strands. The strands are combined by twisting, braiding, or the like to form the first recoil control assembly 230. The characteristics of the first recoil control assembly 230 are selected such that the first recoil control assembly 230 will break before the rope assembly.

The second recoil control assembly 232 is a rope segment defining a first end portion 250, a second end portion 252, and a middle portion 254. The first end portion defines a first loop 250*a* and a second splice 250*b*. The second end portion defines a second loop 252*a* and a second splice 252*b*. The example second recoil control assembly 232 comprises synthetic fibers. The individual fibers are typically combined into yarns which are in turn combined into strands. The strands are combined by twisting, braiding, or the like to form the second recoil control assembly 232. The characteristics of the second recoil control assembly 232 are selected such that the second recoil control assembly 232 will break before the rope assembly.

The middle portion 254 of the second recoil control assembly 232 is folded to define a first middle portion 260, a second middle portion 262, and a connecting portion 264. The example first and second middle portions 260 and 262 are mirror images of each other, and only the first middle portion 260 will be described herein in detail. Other fold configurations of the first and second middle portions 260 and 262 may be used instead or in addition.

In a folded configuration as shown in FIGS. 15 and 16, the first middle portion 260 of the middle portion 254 of the second recoil control assembly 232 defines a first segment 270, a second segment 272, a third segment 274, and a fourth segment 276. The example first middle portion 260 further comprises a first bend 280, a second bend 282, a third bend 284, and a fourth bend 286. The first segment 270 extends between the proximal end portion 150 and the first bend 280. The second segment 272 extends between the first bend 280 and the second bend 282. The third segment 274 extends between the second bend 282 and the third bend 284. The fourth segment 276 extends between the third bend 284 and the fourth bend 286. The fourth bend 286 is connected to the connecting portion 264.

To form the third example recoil control system 220, the first loop 240*a* of the first end portion 240 is aligned with the first loop 250*a* of the second end portion 250 and the second loop 242*a* of the second end portion 242 is aligned with the second loop 252*a* of the second end portion 252. With the second recoil control assembly 232 in its folded configuration, the straps 234*a,b* and 236*a,b* are arranged to hold the second recoil control assembly 232 in the folded configuration and in place relative to the first recoil control assembly 230 as shown in FIG. 16.

The purpose of the middle portion 254 is to make an effective length of the second recoil control assembly 232 in the folded configuration to be approximately the same as the length of the first recoil control assembly 230. As shown in FIGS. 15-16, when the third example recoil control system 220 is in a first (e.g., retracted or non-extended) configuration, the effective length of both of the first and second recoil control assemblies 230 and 232 is approximately the same and defines a first recoil control effective length equal to a distance D1. However, when third example recoil control system 220 is in a second (e.g., extended) configuration as shown in FIG. 14, the effective length of the second recoil control assembly 232 defines a second recoil control effective length equal to a distance D2.

The process by which the third example recoil control assembly 220 changes from the first configuration to the second configuration is generally similar to that of the first and second example recoil control assemblies 20 and 120 described above. The rope assembly is connected to the recoil control assembly 220 at the first loop 240*a* and second loop 250*a*. The straps 234*a,b* and 236*a,b* are, at this point, still held in place. The third example recoil control assembly 220 is arranged such that second loop 242*a* and second loop 252*b* are placed over the second structure, and the rope assembly is or already has been connected to the first structure.

When either one of the first and second structures moves away from the other of the first and second structures, tension loads are applied to the rope assembly through the recoil control system 220. These tension loads result in a force F applied to the first end portion 240 and proximal end portion 250 away from the second structure. When the force F exceeds a first predetermined maximum recoil control limit, the first recoil control assembly 230 breaks at a failure region such that the third example recoil control assembly 220 defines first and second failure portions.

As generally described above, the rope assembly is constructed such that the rope fails at a predetermined maximum rope limit, where the first predetermined maximum rope limit is greater than the predetermined maximum recoil control limit. The second recoil control assembly 232 defines a second predetermined maximum recoil control limit that may be the same as, greater than, or less than the first predetermined maximum recoil control limit but will in any event typically be less than the predetermined maximum rope limit.

When the first recoil control assembly 230 fails, the straps 234*a,b* and 236*a,b* break, release, or otherwise deform to allow the second recoil control assembly 232 to change from its folded configuration (FIGS. 15 and 16) to its unfolded configuration (FIG. 14). The third example recoil control assembly 220 thus changes from the first configuration (FIG. 16) to the second configuration upon failure of the first recoil control assembly 230. The second recoil control assembly 232 will limit movement of the end of the rope assembly connected to the third recoil control system 220 and thus recoil of the rope assembly.

The third example recoil control system 220 further reduces the likelihood that the rope assembly will break when the tension loads on the rope assembly exceed the first predetermined maximum recoil control limit. However, until the first and second structures move farther away from each other, the second recoil control assembly 232 will prevent the splice region 228 of the rope 226 from moving. Upon failure of the example first recoil control assembly 230, steps may be taken to bring the first and second structures closer together to alleviate tension loads on the rope structure 226 before the tension loads on the second recoil control assembly 232 exceed the second predetermined maximum recoil control limit and thus to prevent failure of the third example recoil control system 220 (e.g., breakage of the second recoil control assembly 232).

The third example recoil control system 220 thus maintains the integrity of the overall rope system formed by the example recoil control system 220 and the rope assembly connected thereto, at least temporarily.

In addition, a user of the recoil control system 220 will know that, if the recoil control system 220 moves from the first configuration to the second configuration, the rope assembly forming a part of the overall rope system has been subjected to loads sufficient to cause the first recoil control assembly 230 to break. This knowledge may inform the user of the overall rope system that, in addition to failure of the recoil control system 220, the rope assembly may also need inspection, testing, and/or replacement.

IV. Fourth Example Recoil Control System

Figure 17:
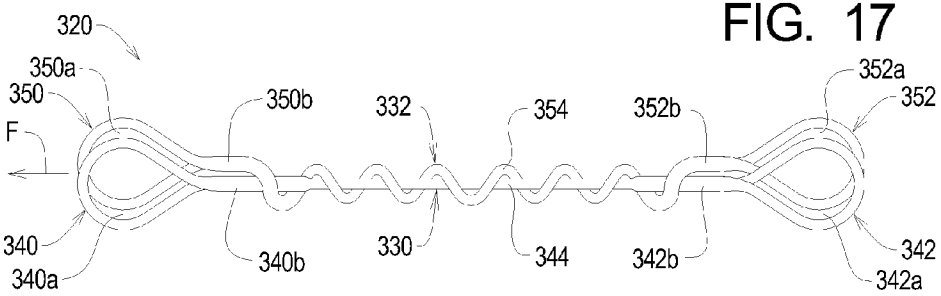
FIG. 17 is a somewhat schematic plan view of a portion of a fourth example recoil control system in a folded configuration.
Figure 18:
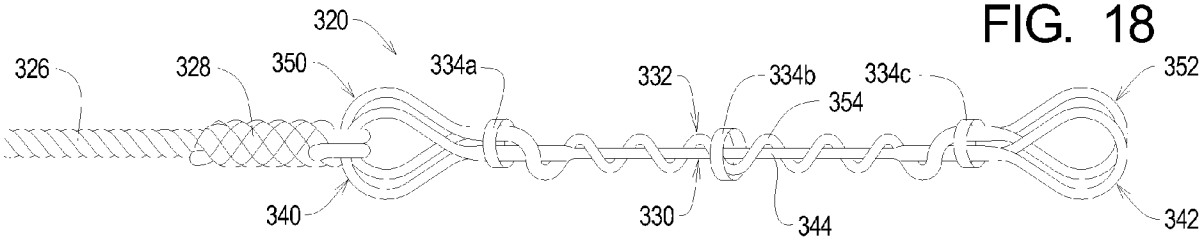
FIG. 18 is a somewhat schematic plan view of the fourth example recoil control system in the folded configuration.

FIGS. 17 and 18 illustrate a fourth example recoil control system 320 constructed in accordance with, and embodying, the principles of the present invention. The fourth example recoil control system 320 is adapted to be connected between a first structure and a second structure. The first structure may be a cleat or the like supported by a ship, and the second structure may be a bollard or the like supported by a dock. The first and second structures are not by themselves part of the present invention and will be described herein only to that extent necessary for a complete understanding of the present invention.

The fourth example recoil control system 320 is directly connected to the second structure. For example, the fourth example recoil control system 320 may define a first loop that is placed over the bollard forming the second structure. The fourth example recoil control system 320 is connected to the first structure through a rope assembly. In the example recoil control system 320, the rope assembly is spliced around a portion of a second loop formed by the fourth example recoil control system 320 such that, under certain conditions, tension loads applied on the rope assembly from the recoil control system 320 at one end and from the first structure at the other end are effectively transferred to the second structure through the fourth example recoil control system 320 as will be described in detail below.

The fourth example recoil control system 320 comprises a first recoil control assembly 330, a second recoil control assembly 332, and, optionally, straps 334*a*, 334*b*, and 334*c*.

The first recoil control assembly 330 is a rope segment defining a first end portion 340, a second end portion 342, and a middle portion 344. The first end portion defines a first loop 340*a* and a second splice 340*b*. The second end portion defines a second loop 342*a* and a second splice 342*b*. The example first recoil control assembly 330 comprises synthetic fibers. The individual fibers are typically combined into yarns which are in turn combined into strands. The strands are combined by twisting, braiding, or the like to form the first recoil control assembly 330. The characteristics of the first recoil control assembly 330 are selected such that the first recoil control assembly 330 will break before the rope assembly.

The second recoil control assembly 332 is a rope segment defining a first end portion 350, a second end portion 352, and a middle portion 354. The first end portion defines a first loop 350*a* and a second splice 350*b*. The second end portion defines a second loop 352*a* and a second splice 352*b*. The example second recoil control assembly 332 comprises synthetic fibers. The individual fibers are typically combined into yarns which are in turn combined into strands. The strands are combined by twisting, braiding, or the like to form the second recoil control assembly 332. The characteristics of the second recoil control assembly 332 are selected such that the second recoil control assembly 332 will break before the rope assembly.

To form the fourth example recoil control system 320, the first loop 340*a* of the first end portion 340 is aligned with the first loop 350*a* of the second end portion 350 and the second loop 342*a* of the second end portion 342 is aligned with the second loop 352*a* of the second end portion 352. The middle portion 354 of the second recoil control assembly 332 is twisted around the middle portion 344 of the first recoil control assembly 330 to hold the first and second recoil control assemblies 330 and 332 in a desired orientation during normal use. The optional straps 334*a,b,c* may be arranged as shown in FIG. 18 to ensure that the second recoil control assembly 332 does not untwist during handling prior to connection of the recoil control system 320 between the rope assembly and the second structural member.

The purpose of the middle portion 354 is to make an effective length of the second recoil control assembly 332 in the folded configuration to be approximately the same as the length of the first recoil control assembly 330. When the fourth example recoil control system 320 is in the first configuration, the effective length of both of the first and second recoil control assemblies 330 and 332 is approximately the same and defines a first recoil control effective length equal to a first distance. However, when fourth example recoil control system 320 is in a second configuration (not shown), the effective length of the second recoil control assembly 332 defines a second recoil control effective length equal to a second distance, where the second distance is greater than the first distance.

The process by which the fourth example recoil control assembly 320 changes from a first (e.g., retracted or non-extended) configuration to a second (e.g., extended) configuration is generally similar to that of the first, second, and third example recoil control systems 20, 120, and 220 described above. The rope assembly is connected to the recoil control assembly 320 at the first loop 340*a* and second loop 350*a*. The straps 334*a,b,c* are, at this point, still held in place. The fourth example recoil control assembly 320 is arranged such that second loop 342*a* and second loop 352*b* are placed over the second structure, and the rope assembly is or already has been connected to the first structure.

When either one of the first and second structures moves away from the other of the first and second structures, tension loads are applied to the rope assembly through the recoil control system 320. These tension loads result in a force F applied to the first end portion 340 and proximal end portion 350 away from the second structure. When the force F exceeds a first predetermined maximum recoil control limit, the first recoil control assembly 330 breaks at a failure region such that the fourth example recoil control assembly 320 defines first and second failure portions.

As generally described above, the rope assembly is constructed such that the rope fails at a predetermined maximum rope limit, where the first predetermined maximum rope limit is greater than the predetermined maximum recoil control limit. The second recoil control assembly 332 defines a second predetermined maximum recoil control limit that may be the same as, greater than, or less than the first predetermined maximum recoil control limit but will in any event typically be less than the predetermined maximum rope limit.

When the first recoil control assembly 330 fails, the straps 334*a,b,c* break, release, or otherwise deform to allow the second recoil control assembly 332 to change from its folded configuration (FIGS. 17 and 18) to its unfolded configuration. The fourth example recoil control assembly 320 thus changes from the first configuration (FIG. 18) to the second configuration upon failure of the first recoil control assembly 330. The second recoil control assembly 332 will limit movement of the end of the rope assembly connected to the third recoil control system 320 and thus recoil of the rope assembly.

The fourth example recoil control system 320 further reduces the likelihood that the rope assembly will break when the tension loads on the rope assembly exceed the first predetermined maximum recoil control limit. However, until the first and second structures move farther away from each other, the second recoil control assembly 332 will prevent the splice region 328 of the rope 326 from moving. Upon failure of the example first recoil control assembly 330, steps may be taken to bring the first and second structures closer together to alleviate tension loads on the rope structure 326 before the tension loads on the second recoil control assembly 332 exceed the second predetermined maximum recoil control limit and thus to prevent failure of the fourth example recoil control system 320 (e.g., breakage of the second recoil control assembly 332).

The fourth example recoil control system 320 thus maintains the integrity of the overall rope system formed by the example recoil control system 320 and the rope assembly connected thereto, at least temporarily.

In addition, a user of the recoil control system 320 will know that, if the recoil control system 320 moves from the first configuration to the second configuration, the rope assembly forming a part of the overall rope system has been subjected to loads sufficient to cause the first recoil control assembly 330 to break. This knowledge may inform the user of the overall rope system that, in addition to failure of the recoil control system 320, the rope assembly may also need inspection, testing, and/or replacement.

V. Fifth Example Recoil Control System

Figure 19:
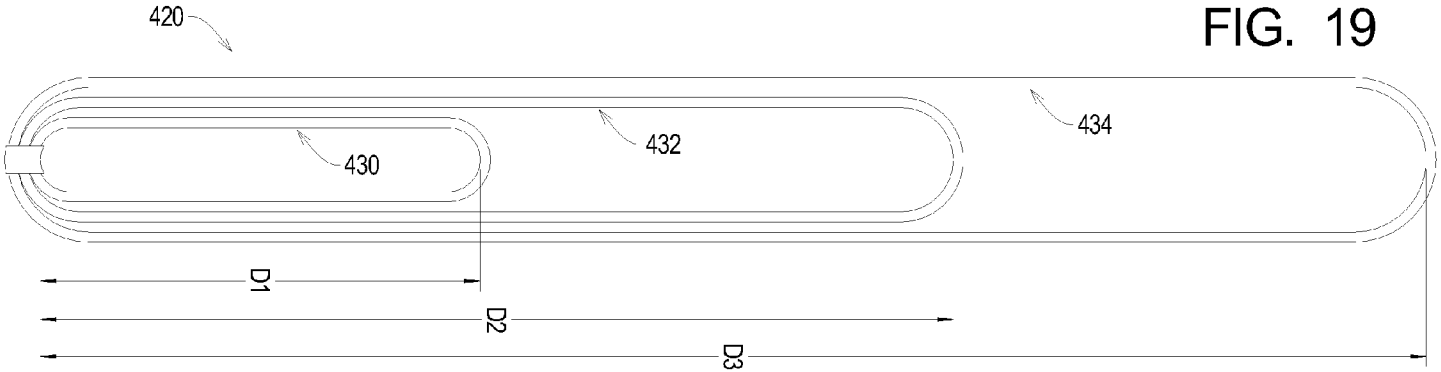
FIG. 19 is a somewhat schematic plan view of a portion of a fourth example recoil control system in an unfolded configuration.

Referring now to FIG. 19, depicted therein is a fifth example recoil control system 420 similar to the first example recoil control system 20 described above. However, the fifth example recoil control system 420 comprises first, second, and third recoil control assemblies 430, 432, and 434 and not just two recoil control assemblies. The use of three recoil control assemblies defines first, second, and third distances D1, D2, and D3 as shown in FIG. 19. The fifth example recoil control system 420 thus has an additional recoil control assembly 434 that will prevent recoil should both the first and second recoil control assemblies 430 and 432 fail. As with the first recoil control assembly 432, a predetermined recoil control maximum limit associated with the second recoil control assembly 434 is less than a predetermined maximum rope limit at which the rope assembly fails.

The second and third recoil control assemblies 432 and 434 are folded, twisted, or the like as generally described above to define folded configurations that yield a first configuration yielding an effective length of the firth example recoil control system of D1. The first and second recoil control assemblies 430, 432, and 434 may be held together by one or more straps and/or one or more covers when the fifth example recoil control assembly 420 is in its first configuration.

What is claimed is:

1. A rope system adapted to be connected between first and second structures comprising:

a recoil control system comprising a first recoil control assembly defining a first length and a first predetermined recoil control maximum limit at which the first recoil control assembly fails when under tension, and a second recoil control assembly defining a second length; wherein the second length is longer than the first length;

the recoil control assembly is arranged between the first and second structures such that the recoil control system is in a first configuration;

at least a portion of the second recoil control assembly is in a folded configuration when the recoil control system is in the first configuration; and when at least one of the first and second structures moves away from another of the first and second structures, the first recoil control assembly fails and the recoil control system reconfigures into a second configuration.

2. A rope system as recited in claim 1, further comprising a rope assembly connected between the recoil control system and one of the first and second structures.

3. A rope system as recited in claim 1, in which the first predetermined recoil control maximum limit is less than a predetermined rope limit at which the rope assembly fails.

4. A rope system as recited in claim 1, in which at least a portion of the second recoil control assembly is in an unfolded configuration when the recoil control system is in the second configuration.

5. A rope system as recited in claim 1, in which at least a portion of the second recoil control assembly is in an unfolded configuration when the recoil control system is in the second configuration.

6. A rope system as recited in claim 1, in which the first recoil control assembly takes the form of a cover that extends around at least a portion of the second recoil control assembly when the recoil control system is in the first configuration.

7. A rope system as recited in claim 1, in which the at least a portion of the second recoil control assembly is twisted around at least a portion of the first recoil control assembly when the recoil control system is in the first configuration.

8. A rope system as recited in claim 1, further comprising a cover that extends around at least a portion of the first and second recoil control assemblies when the recoil control system is in the first configuration.

9. A rope system as recited in claim 1, further comprising at least one strap that extends around at least a portion of the first and second recoil control assemblies when the recoil control system is in the first configuration.

10. A rope system as recited in claim 1, further comprising a third recoil control assembly defining a third length, in which:

the second recoil control assembly defines a second predetermined recoil control maximum limit at which the second recoil control assembly fails when under tension;

the third length is longer than the second length; and when the second recoil control assembly fails, the recoil control system reconfigures into a third configuration.

11. A rope system as recited in claim 1, in which at least one of the first and second recoil control assemblies defines an endless loop.

12. A rope system as recited in claim 1, in which the first and second recoil control assemblies each defines an endless loop.

13. A rope system as recited in claim 1, in which at least one of the first and second recoil control assemblies defines first and second loops connected by a middle portion.

14. A rope system as recited in claim 1, in which the first and second recoil control assemblies each defines first and second loops connected by a middle portion.

15. A method of connecting first and second structures comprising the steps of:

providing a first recoil control assembly defining a first length and a first predetermined recoil control maximum limit at which the first recoil control assembly fails when under tension;

providing a second recoil control assembly defining a second length, where the second length is longer than the first length;

combining the first and second recoil control assemblies to form a recoil control system in a first configuration, where at least a portion of the second recoil control assembly is in a folded configuration when the recoil control system is in the first configuration;

arranging the recoil control assembly between the first and second structures in the first configuration such that, when at least one of the first and second structures moves away from another of the first and second structures, the first recoil control assembly fails and the recoil control system reconfigures into a second configuration.

16. A method as recited in claim 15, further comprising the step of arranging a rope assembly between the recoil control system and at least one of the first and second structures.

17. A recoil control system adapted to be connected between a rope assembly and a structure, comprising:

a first recoil control assembly defining a first length and a first predetermined recoil control maximum limit at which the first recoil control assembly fails when under tension; and a second recoil control assembly defining a second length; wherein the second length is longer than the first length;

the recoil control assembly is arranged between the rope and the structure such that the recoil control system is in a first configuration; and when tension is applied from the rope assembly to the structure through the recoil control system, the first recoil control assembly fails and the recoil control system reconfigures into a second configuration.

18. A recoil control system as recited in claim 17, in which a predetermined rope limit at which the rope assembly fails is greater than the first predetermined recoil control maximum limit.

19. A recoil control system as recited in claim 17, in which at least a portion of the second recoil control assembly is in a folded configuration when the recoil control system is in the first configuration.

20. A rope system adapted to be connected between first and second structures comprising:

a recoil control system comprising a first recoil control assembly defining a first length and a first predetermined recoil control maximum limit at which the first recoil control assembly fails when under tension, and a second recoil control assembly defining a second length; wherein the second length is longer than the first length;

the recoil control assembly is arranged between the first and second structures such that the recoil control system is in a first configuration;

when at least one of the first and second structures moves away from another of the first and second structures, the first recoil control assembly fails and the recoil control system reconfigures into a second configuration; and the first recoil control assembly takes the form of a cover that extends around at least a portion of the second recoil control assembly when the recoil control system is in the first configuration.

21. A rope system adapted to be connected between first and second structures comprising:

a recoil control system comprising a first recoil control assembly defining a first length and a first predetermined recoil control maximum limit at which the first recoil control assembly fails when under tension, and a second recoil control assembly defining a second length; wherein the second length is longer than the first length;

the recoil control assembly is arranged between the first and second structures such that the recoil control system is in a first configuration;

when at least one of the first and second structures moves away from another of the first and second structures, the first recoil control assembly fails and the recoil control system reconfigures into a second configuration; and the at least a portion of the second recoil control assembly is twisted around at least a portion of the first recoil control assembly when the recoil control system is in the first configuration.

22. A rope system adapted to be connected between first and second structures comprising:

a recoil control system comprising a first recoil control assembly defining a first length and a first predetermined recoil control maximum limit at which the first recoil control assembly fails when under tension, a second recoil control assembly defining a second length, and a cover; wherein the second length is longer than the first length;

the recoil control assembly is arranged between the first and second structures such that the recoil control system is in a first configuration;

when at least one of the first and second structures moves away from another of the first and second structures, the first recoil control assembly fails and the recoil control system reconfigures into a second configuration; and the cover extends around at least a portion of the first and second recoil control assemblies when the recoil control system is in the first configuration.

23. A rope system adapted to be connected between first and second structures comprising:

a recoil control system comprising a first recoil control assembly defining a first length and a first predetermined recoil control maximum limit at which the first recoil control assembly fails when under tension, a second recoil control assembly defining a second length, and at least one strap; wherein the second length is longer than the first length;

the recoil control assembly is arranged between the first and second structures such that the recoil control system is in a first configuration;

when at least one of the first and second structures moves away from another of the first and second structures, the first recoil control assembly fails and the recoil control system reconfigures into a second configuration; and the at least one strap extends around at least a portion of the first and second recoil control assemblies when the recoil control system is in the first configuration.

24. A rope system adapted to be connected between first and second structures comprising:

a recoil control system comprising a first recoil control assembly defining a first length and a first predetermined recoil control maximum limit at which the first recoil control assembly fails when under tension, a second recoil control assembly defining a second length, and a third recoil control assembly defining a third length; wherein the second length is longer than the first length;

the recoil control assembly is arranged between the first and second structures such that the recoil control system is in a first configuration;

when at least one of the first and second structures moves away from another of the first and second structures, the first recoil control assembly fails and the recoil control system reconfigures into a second configuration;

the second recoil control assembly defines a second predetermined recoil control maximum limit at which the second recoil control assembly fails when under tension; the third length is longer than the second length; and when the second recoil control assembly fails, the recoil control system reconfigures into a third configuration.

25. A rope system adapted to be connected between first and second structures comprising:

a recoil control system comprising a first recoil control assembly defining a first length and a first predetermined recoil control maximum limit at which the first recoil control assembly fails when under tension, and a second recoil control assembly defining a second length; wherein the second length is longer than the first length;

the recoil control assembly is arranged between the first and second structures such that the recoil control system is in a first configuration;

when at least one of the first and second structures moves away from another of the first and second structures, the first recoil control assembly fails and the recoil control system reconfigures into a second configuration; and at least one of the first and second recoil control assemblies defines an endless loop.

26. A rope system as recited in claim 25, in which the first and second recoil control assemblies each defines an endless loop.

27. A rope system as recited in claim 25, in which at least one of the first and second recoil control assemblies defines first and second loops connected by a middle portion.

28. A rope system as recited in claim 25, in which the first and second recoil control assemblies each defines first and second loops connected by a middle portion.

* * * * *